US010161105B2

(12) United States Patent
Nakamura

(10) Patent No.: US 10,161,105 B2
(45) Date of Patent: Dec. 25, 2018

(54) REVOLVING FRAME AND WORK MACHINE COMPRISING SUCH A FRAME

(71) Applicant: CATERPILLAR SARL, Geneva (CH)

(72) Inventor: Takeshi Nakamura, Tokyo (JP)

(73) Assignee: Caterpillar SARL, Geneva (CH)

( * ) Notice: Subject to any disclaimer, the term of this patent is extended or adjusted under 35 U.S.C. 154(b) by 156 days.

(21) Appl. No.: 14/786,706

(22) PCT Filed: Apr. 24, 2014

(86) PCT No.: PCT/EP2014/058395
§ 371 (c)(1),
(2) Date: Oct. 23, 2015

(87) PCT Pub. No.: WO2014/174042
PCT Pub. Date: Oct. 30, 2014

(65) Prior Publication Data

US 2016/0083929 A1 Mar. 24, 2016

(30) Foreign Application Priority Data

Apr. 26, 2013 (JP) ..... 2013-093234

(51) Int. Cl.
*E02F 9/08* (2006.01)
*E02F 9/12* (2006.01)

(52) U.S. Cl.
CPC ..... *E02F 9/0816* (2013.01); *E02F 9/121* (2013.01)

(58) Field of Classification Search
CPC ..... B62D 21/186; B62D 55/10; E02F 9/0808; E02F 9/0816; E02F 9/121
(Continued)

(56) References Cited

U.S. PATENT DOCUMENTS 6,098,739 A * 8/2000 Anderson ..... B62D 21/186 180/312
6,158,525 A * 12/2000 Inoue ..... B62D 21/186 172/776
(Continued)

FOREIGN PATENT DOCUMENTS

CN 201 817 838 U 5/2011
JP 07-150589 A 6/1995
(Continued)

OTHER PUBLICATIONS

International Search Report dated Jul. 7, 2014 from Application No. PCT/EP2014/058395.

*Primary Examiner* — Saul Rodriguez
*Assistant Examiner* — Brendan P Tighe

(57) ABSTRACT

A revolving frame includes a center frame and a plurality of beams welded to a side surface of the center frame and extending away from the center frame along a transverse direction. The plurality of beams includes a skirt beam that includes a pair of beam side plates having a first end that is welded to the side surface of the center frame. An upper surface of each beam side plate has a notch surface that extends from the first end to a notch edge. The notch surface defines a notch groove, such that the notch edge of each beam side plate is separated from the center frame along the transverse direction by a gap across the notch groove. The skirt beam further includes a beam upper plate integrally fixed to the pair of beam side plates, and a notch connection plate welded to each beam side plate.

14 Claims, 4 Drawing Sheets

(58) Field of Classification Search
USPC ..... 37/397; 172/776; 212/253; 414/687, 414/694
See application file for complete search history.

(56) References Cited

U.S. PATENT DOCUMENTS

| | | | | |
|---|---|---|---|---|
| 2008/0073938 | A1 * | 3/2008 | Lee | E02F 9/121 296/190.08 |
| 2010/0290883 | A1 | 11/2010 | Kitatani et al. | |

FOREIGN PATENT DOCUMENTS

| | | | | |
|---|---|---|---|---|
| JP | H07 260689 | A | 6/1995 | |
| JP | H10 37243 | A | 2/1998 | |
| JP | 2007 046374 | A | 2/2007 | |
| KR | 200 168 768 | A | 2/2000 | |
| KR | 2008 0093582 | A | 10/2008 | |
| WO | WO-2005032996 | A1 * | 4/2005 | B66F 9/0655 |
| WO | WO-2006033311 | A1 * | 3/2006 | B62D 21/186 |

* cited by examiner

REVOLVING FRAME AND WORK MACHINE COMPRISING SUCH A FRAME

CROSS-REFERENCE TO RELATED APPLICATIONS

This application is a National Stage of International Patent Application No. PCT/EP2014/058395, filed Apr. 24, 2014, which claims priority to foreign Japanese Patent Application No. 2013-093234, filed Apr. 26, 2013, the content of which are incorporated herein by reference in their entirety.

TECHNICAL FIELD

The present invention relates to a revolving frame having a characteristic welded structure and a work machine including the revolving frame.

BACKGROUND

As illustrated in FIGS. 6 and 7, although a revolving frame 1 of a hydraulic shovel or the like has a skirt beam 3 which is fixed to a side surface of a center frame 2 by a welding portion 4, high stress is generated in an upper portion of the center frame 2 when a vehicle vibrates. Thus, on a rear side of a vehicle of which the height of the center frame 2 is low, a high stress generating portion 5 of the center frame 2 is close to the welding portion 4 of the skirt beam 3. As a result, the welding portion 4 is likely to be affected by the stress, and the strength and durability of the welding portion 4 are a matter of concern. Therefore, it is necessary to add a reinforcing material, processing of a weld toe, and the like during the welding.

On the other hand, a revolving frame in which a gap is formed between a center frame and a sponson beam for supporting a cab and the center frame and the sponson beam are not welded directly to prevent the influence of stress is proposed (for example, see Patent Document 1).

SUMMARY OF THE DISCLOSURE

When this gap structure is applied to portions where the skirt beams 3 are connected to the center frame 2, since the skirt beams 3 are not directly connected to the center frame 2, it is not possible to transmit the load applied to the skirt beams 3 of a fuel tank, a hydraulic oil tank, and the like mounted on the skirt beams 3 to the center frame 2. Thus, it is not advantageous to the strength of the skirt beams 3.

With the foregoing in view, it is an object of the present invention to provide a revolving frame having a welded structure capable of reducing the influence of stress from the center frame on portions in which beams are welded to the center frame and securing load supporting strength of the beams and to provide a work machine including the revolving frame.

According to a first aspect of the invention, there is provided a revolving frame including: a center frame provided so that a longitudinal direction thereof extends in a horizontal direction from a supporting portion and a height thereof decreases gradually in the longitudinal direction from the supporting portion; and a revolving frame having a plurality of beams welded to side surfaces of the center frame so as to support the load of a mounted object, wherein a beam welded further toward a rear side than a center of an entire length in the longitudinal direction of the center frame includes: a pair of beam side plates which has a notch groove formed by notching an upper portion of a distal end portion near the side surface of the center frame and in which a lower portion of the distal end portion is welded to a region on a lower side than a center in a height direction of the side surface of the center frame by a vertical welding portion; a beam upper plate integrally provided between upper portions of these beam side plates; and a notch connection plate which is welded between the pair of beam side plates so as to extend from the beam upper plate to reach the side surface of the center frame along the notch grooves and in which a distal end is welded to an intermediate portion in a height direction of the side surface of the center frame by a horizontal welding portion.

According to a second aspect of the present invention, there is provided the revolving frame according to claim 1 further including a pair of notch holes formed between the pair of beam side plates and the notch connection plate at a position adjacent to a welding portion welded to the side surface of the center frame by notching the pair of beam side plates and the notch connection plate.

According to a third aspect of the present invention, there is provided a work machine including: a lower traveling structure; an upper revolving structure provided so as to revolve in relation to the lower traveling structure; and a working device provided on the upper revolving structure, wherein the upper revolving structure includes the revolving frame according to the first or second aspect, and the working device is attached to the center frame of the revolving frame.

According to the first aspect of the present invention, when the beams are welded to the side surface of the center frame of which the height decreases as it advances in the longitudinal direction from the supporting portion, the welding portion in the upper portion of the beam welded to the rear side than the center of the entire length in the longitudinal direction of the center frame approaches the upper portion of the center frame in the conventional art and is likely to be influenced by the stress generated in the upper portion of the center frame. However, the upper portions of the distal end portions of the pair of beam side plates approaching the side surface of the center frame are notched to form the pair of notch grooves, the notch connection plate is welded between the pair of beam side plates so as to extend from the beam upper plate formed integrally between the upper portions of the pair of beam side plates to reach the side surface of the center frame along the notch grooves, and the distal end of the notch connection plate is welded to the intermediate portion in the height direction of the side surface of the center frame by the horizontal welding portion. In this way, a structure in which the height of the beam welded to the rear side near the welding portion is lowered is obtained. With this structure, it is possible to secure a distance for reducing the stress between the upper portion of the center frame and the welding portion of the beam. It is possible to reduce the influence of the stress applied to the welding portion of the beam from the upper portion of the center frame. Moreover, it is possible to transmit the load applied to the beam to the center frame through the welding portions by welding the center frame and the beam at lowered portions. It is possible to secure the load supporting strength of the beam that supports the load of mounted objects.

According to the second aspect of the present invention, the stress acting on the welding portions of the pair of beam side plates and the notch connection plate welded to the side surface of the center frame can be distributed by the pair of notch holes formed by notching the portions near the welding portions. Thus, it is possible to relieve concentration of stress that results in the rupture of the welding portions.

According to the third aspect of the present invention, it is possible to provide a work machine having a strong frame structure capable of reducing the influence of the stress acting on the welding portions of the beam welded to the rear side than the center of the entire length in the longitudinal direction of the center frame from the working device provided on the upper revolving structure so as to revolve in relation to the lower traveling structure through the center frame with the aid of the notch groove and the notch connection plate of the beam and securing the load supporting strength of the beam that supports the load of mounted objects.

BEST MODE FOR CARRYING OUT THE INVENTION

Hereinafter, the present invention will be described in detail based on an embodiment illustrated in FIGS. 1 to 5.

Figure 3:
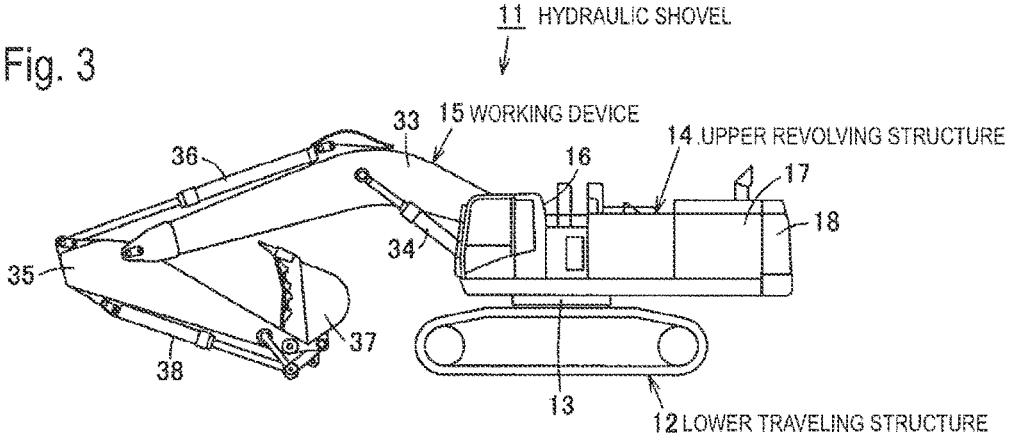
FIG. 3 is a side view of a work machine including the revolving frame.

As illustrated in FIG. 3, a hydraulic shovel 11 as a work machine includes a crawler belt-type lower traveling structure 12, an upper revolving structure 14 provided so as to revolve in relation to the lower traveling structure 12 with a revolving bearing portion 13 interposed, and a working device 15 provided on the upper revolving structure 14. A cab 16 is mounted on the front side of the upper revolving structure 14, and a mechanical room 17 for, for example, an engine and a counterweight 18 are mounted on the rear side.

Figure 4:
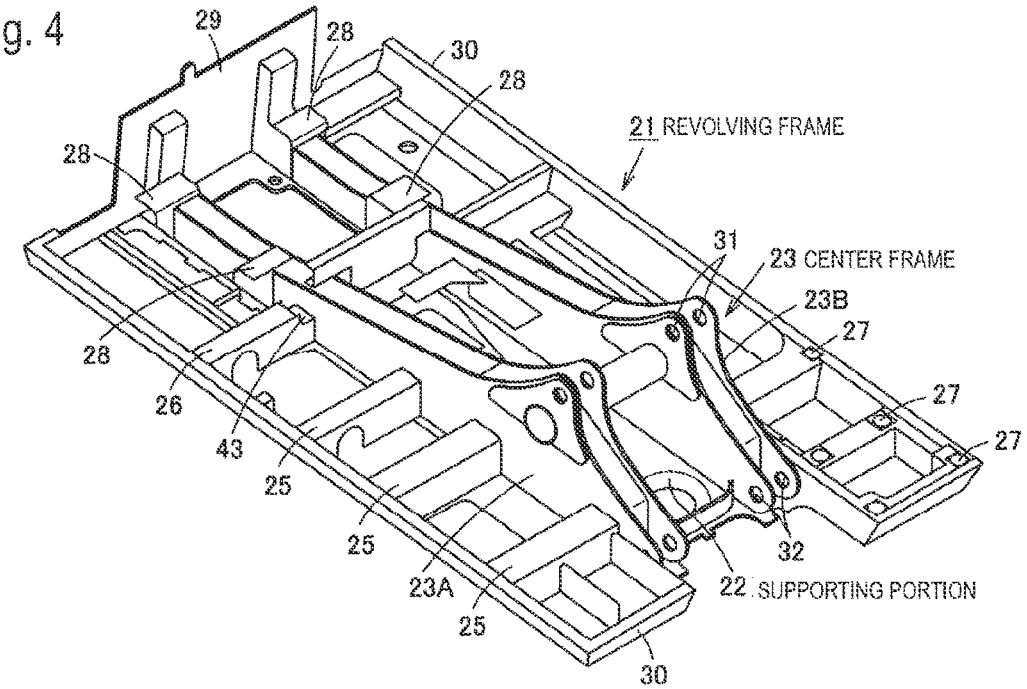
FIG. 4 is a perspective view of the revolving frame.

The upper revolving structure 14 includes a revolving frame 21 illustrated in FIG. 4, and the revolving frame 21 has a center frame 23 which is provided so that a longitudinal direction extends in the horizontal direction from a supporting portion 22 that is revolvably supported by the revolving bearing portion 13. The center frame 23 includes a pair of center frames 23A and 23B. These center frames 23A and 23B have such a shape that portions which are located near the supporting portion 22 serving as the center of revolution and in which boom foot pin holes 31 are formed are highest, and that the farther in the longitudinal direction from the supporting portion 22 or the vicinity of the supporting portion 22 (that is, the closer to the rear side of the body), the lower the height. The center frame has such a shape because an engine is mounted on the rear side of the body.

Figure 2:
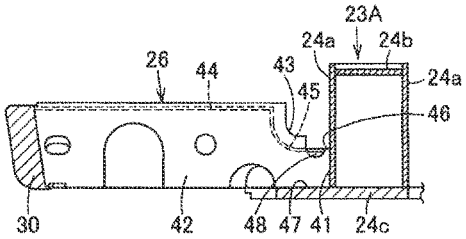
FIG. 2 is a cross-sectional view near the welding portion of the revolving frame.

As illustrated in FIG. 2, these center frames 23A and 23B have a box-shaped cross-section formed by a pair of side surfaces 24*a*, an upper surface 24*b* welded between the upper portions of the side surfaces 24*a*, and a bottom plate 24*c* welded to the lower portions of the side surfaces 24*a*.

As illustrated in FIG. 4, skirt beams 25 and 26 as a plurality of beams that supports the load of mounted objects such as a fuel tank and a hydraulic oil tank are welded to the side surfaces of one center frame 23A.

The revolving frame 21 further includes cab mounting portions 27 for supporting the cab 16, engine mounting portions 28 for supporting the engine, a counter weight attachment portion 29 to which the counterweight 18 is attached, a peripheral skirt portion 30 provided at distal ends of the skirt beams 25 and 26, and the like.

In the working device 15, a boom 33 and boom cylinders 34 that rotate the boom 33 illustrated in FIG. 3 are pivotally supported by the boom foot pin holes 31 and boom cylinder holes 32 of the center frame 23 located near the supporting portion 22. A stick 35 is pivotally supported by a distal end of the boom 33 so as to be rotated by a stick cylinder 36. A bucket 37 is pivotally supported by a distal end of the stick 35 so as to be rotated by a bucket cylinder 38.

As illustrated in FIG. 4, the skirt beam 26 welded to the rear side than the center of an entire length in the longitudinal direction of the center frame 23A is formed in a 2-stage beam shape in portions welded to a side surface of the center frame 23A.

Figure 1:
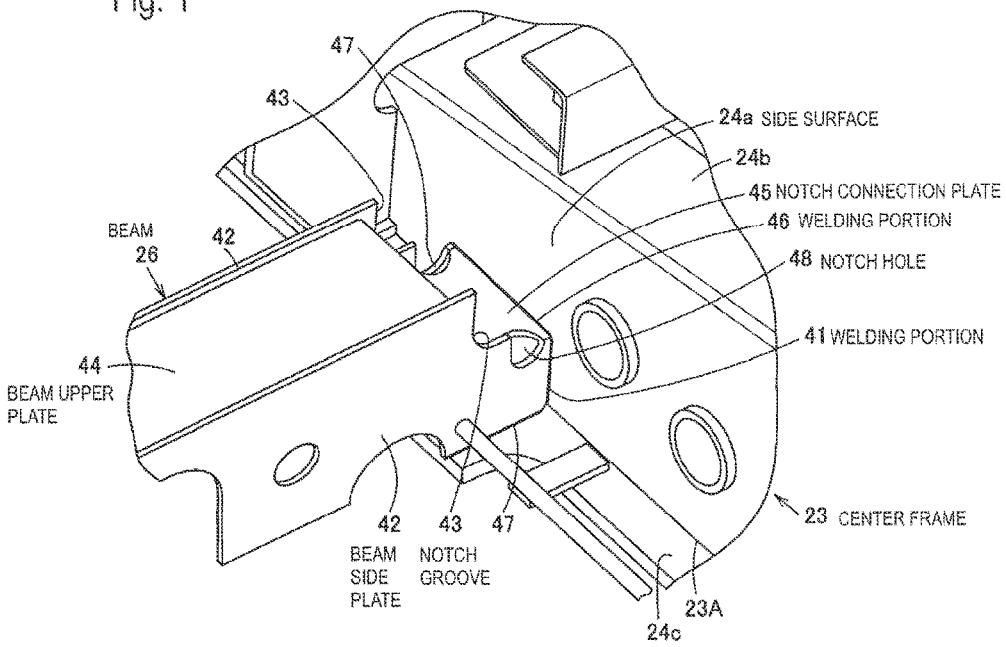
FIG. 1 is a perspective view near a welding portion illustrating an embodiment of a revolving frame according to the present invention.

That is, as illustrated in FIGS. 1 and 2, a pair of beam side plates 42 is welded to a region of the side surface 24*a* of the center frame 23A on a lower side than the center in the height direction by a vertical welding portion 41. These beam side plates 42 have a pair of notch grooves 43 formed by notching the upper portions of the distal ends near the side surface 24*a* of the center frame 23A in an L-shape.

A beam upper plate 44 is welded between and integrated with the upper portions of the pair of beam side plates 42. A notch connection plate 45 formed to extend in an L-shape from the beam upper plate 44 to the side surface 24*a* along the notch grooves 43 is continuously welded between the pair of beam side plates 42 similarly to the beam upper plate 44. The distal end of the notch connection plate 45 is welded to an intermediate portion in the height direction of the side surface 24*a* by a horizontal welding portion 46. Moreover, the bottom plate 24*c* and the beam side plates 42 are welded by a welding portion 47.

The pair of beam side plates 42, the beam upper plate 44, and the notch connection plate 45 may be formed integrally, for example, by incising and bending one structural steel of a C-shaped cross-section, cutting an unnecessary portion, and welding a resulting structure. Moreover, the notch groove 43 and the notch connection plate 45 may not always have an L-shape but may be notched or bent in a circular arc shape, for example.

As illustrated in FIGS. 1 and 2, a pair of notch holes 48 formed by notching the pair of beam side plates 42 and the notch connection plate 45 in a semicircular shape is formed between the pair of beam side plates 42 and the notch connection plate 45 at positions near the vertical and horizontal welding portions 41 and 46 welded to the side surface 24*a* of the center frame 23A.

Figure 5:
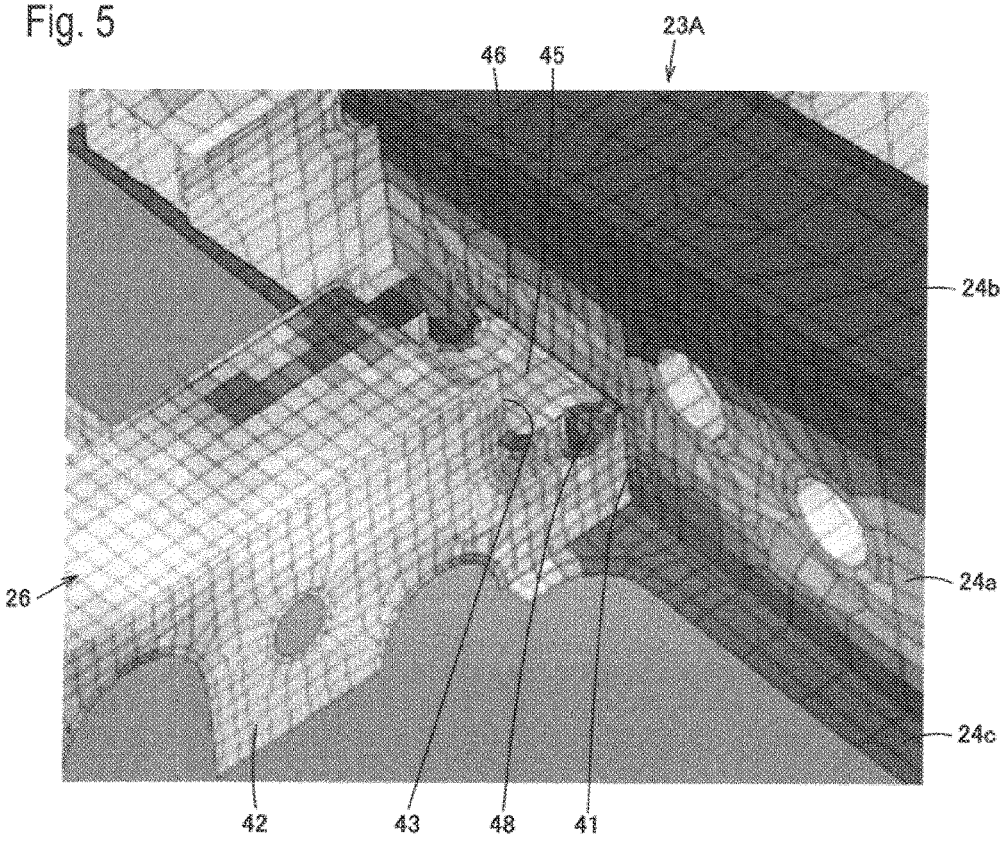
FIG. 5 is a diagram illustrating a stress distribution near the welding portion of the revolving frame.
Figure 6:
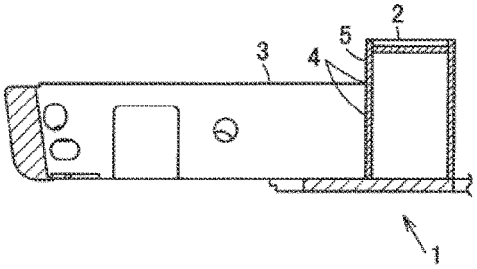
FIG. 6 is a cross-sectional view near a welding portion of a conventional revolving frame.
Figure 7:
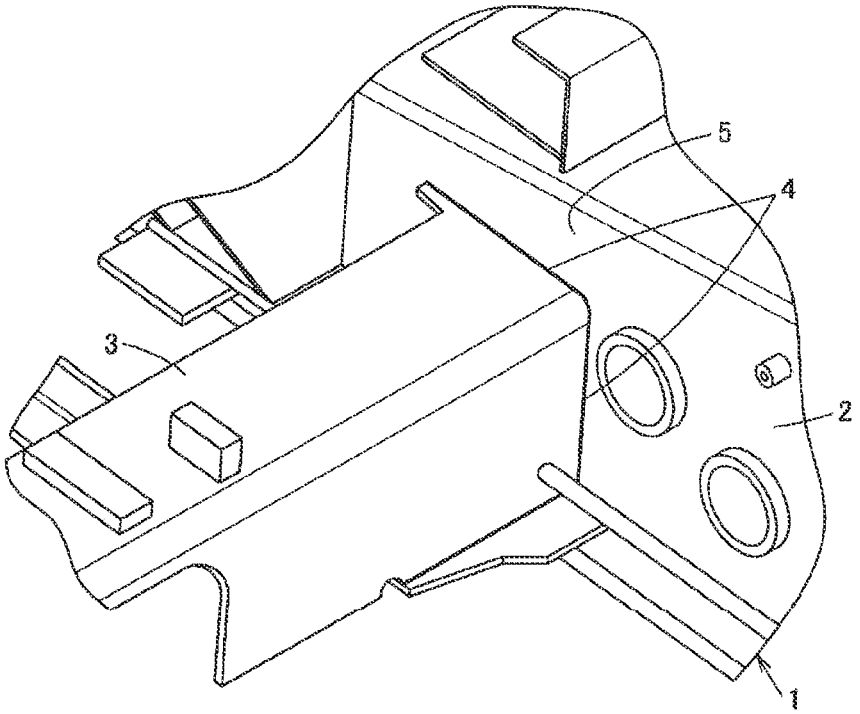
FIG. 7 is a perspective view near the welding portion of the conventional revolving frame.

Next, the operation and effects of the illustrated embodiment will be described with reference to a stress distribution diagram of FIG. 5 illustrating the distribution of stress generated in the center frame 23A when the body vibrates in the vertical direction.

In the stress distribution diagram illustrated in FIG. 5, the darker, the higher the stress. High stress is generated in the upper surface 24*b* and the bottom plate 24*c* of the center frame 23A having a box-shaped cross-section and an upper portion of the side surface 24*a* extending along the upper surface 24*b* due to the weight of the engine, the counterweight 18, and the like mounted at a position away from the supporting portion 22 serving as the center of revolution. On the other hand, high stress is not generated in a region extending along an intermediate height of the side surface 24*a*.

Thus, when the pair of notch grooves 43 is provided so that the welding portion 46 of the skirt beam 26 is located in a region extending along an intermediate height of the side surface 24*a*, the notch connection plate 45 is provided so as to extend along these notch grooves 43 to reach the side surface 24*a*, and the distal end of the notch connection plate 45 is welded to an intermediate portion in the height direction of the side surface 24*a*, the welding portion 46 is hardly influenced by the stress generated in the center frame 23A.

In the skirt beam 26 on the rear side of the body in which the height of the upper surface 24*b* of the center frame 23A is close to the height of the beam upper surface, by employing such a two-stage beam structure that the height of the skirt beam 26 is lowered near the welding portion in order to prevent the influence of the stress from the center frame 23A on the welding portion 46 of the skirt beam 26, a stress-reducing distance is secured between the upper surface 24*b* of the center frame 23A and the welding portion 46 of the skirt beam 26. Moreover, since welding is performed to portions excluding high-stress portions, it is not necessary to add a reinforcing material, processing of a weld toe, and the like.

By welding the center frame 23A and the skirt beam 26 at portions where the influence of stress is lowered, it is possible to transmit the load of tanks and the like applied to the skirt beam 26 to the center frame 23A and to secure the load supporting strength of the skirt beam 26.

That is, when the skirt beam 26 is welded to portions of the center frame 23A excluding the high-stress portion while lowering the height at the welding portion of the skirt beam 26, the load acting on the skirt beam 26 can be transmitted to the center frame 23A.

Conventionally, the height of a portion of the skirt beam 26 welded to the center frame 23A required for transmitting the load of the skirt beam 26 to the center frame 23A is approximately 50% of the beam height (that is, the entire beam height). However, since the relation between the load applied to the skirt beam 26 and the position of the center frame 23A changes depending on a model or the like, the height required at the portion of the skirt beam 26 welded to the center frame 23A may be changed.

As described above, when the skirt beams 25 and 26 are welded to the side surfaces 24*a* of the center frame 23 of which the height decreases as it advances in the longitudinal direction from the supporting portion 22 or the vicinity of the supporting portion 22, the welding portion in the upper portion of the skirt beam 26 welded to the rear side than the center of the entire length in the longitudinal direction of the center frame 23 approaches the upper portion of the center frame 23 in the conventional art and is likely to be influenced by the stress generated in the upper portion of the center frame 23. However, the upper portions of the distal end portions of the pair of beam side plates 42 approaching the side surface 24*a* of the center frame 23 are notched to form the pair of notch grooves 43, the notch connection plate 45 is welded between the pair of beam side plates 42 so as to extend from the beam upper plate 44 formed integrally between the upper portions of the pair of beam side plates 42 to reach the side surfaces 24*a* along the notch grooves 43, and the distal end of the notch connection plate 45 is welded to the intermediate portion in the height direction of the side surface 24*a* of the center frame 23 by the horizontal welding portion 46. In this way, a structure in which the height of the skirt beam 26 welded to the rear side near the welding portion is lowered is obtained.

With this structure, it is possible to secure a distance for reducing the stress between the upper portion of the center frame 23 and the welding portion 46 of the skirt beam 26. It is possible to reduce the influence of the stress applied to the welding portion 46 of the skirt beam 26 from the upper portion of the center frame 23. Moreover, it is possible to transmit the load applied to the skirt beam 26 to the center frame 23 through the welding portions 41, 46, and 47 by welding the center frame 23 and the skirt beam 26 at lowered portions. It is possible to secure the load supporting strength of the skirt beam 26 that supports the load of mounted objects.

Moreover, the stress acting on the welding portions 41 and 46 of the pair of beam side plates 42 and the notch connection plate 45 welded to the side surface 24*a* of the center frame 23 can be distributed by the pair of notch holes 48 formed by notching the portions near the welding portions 41 and 46. Thus, it is possible to relieve concentration of stress that results in the rupture of the welding portions 41 and 46.

Further, it is possible to provide a work machine having a strong frame structure capable of reducing the influence of the stress acting on the welding portions 41 and 46 of the skirt beam 26 welded to the rear side than the center of the entire length in the longitudinal direction of the center frame 23 from the working device 15 provided on the upper revolving structure 14 so as to revolve in relation to the lower traveling structure 12 through the center frame 23 with the aid of the notch groove 43 and the notch connection plate 45 of the skirt beam 26 and securing the load supporting strength of the skirt beam 26 that supports the load of mounted objects.

In the above embodiment, although the structure of welding the skirt beam 26 to one center frame 23A has been described, the present invention can be equally applied to a structure of welding other beams to the other center frame 23B.

Further, the revolving frame 21 of the present invention is not limited to the hydraulic shovel but can be applied to a self-propelled or stationary crane or the like, for example.

INDUSTRIAL APPLICABILITY

The present invention can be useful to companies that manufacture revolving frames such as hydraulic shovels and cranes, and work machines.

EXPLANATION OF REFERENCE NUMERALS

11: Hydraulic shovel as work machine
12: Lower traveling structure
14: Upper revolving structure
15: Working device
21: Revolving frame
22: Supporting portion
23: Center frame
24*a*: Side surface
26: Skirt beam as beam
41: Welding portion
42: Beam side plate
43: Notch groove
44: Beam upper plate
45: Notch connection plate

46: Welding portion
48: Notch hole

The invention claimed is:

1. A revolving frame comprising:

a center frame having a supporting portion disposed opposite a rear portion along a horizontal direction, and having a height along a vertical direction that increases gradually from the rear portion toward the supporting portion along the horizontal direction, the vertical direction being perpendicular to the horizontal direction; and a plurality of beams welded to a side surface of the center frame to support a load of a mounted object, each beam of the plurality of beams extending away from the center frame along a transverse direction, the transverse direction being perpendicular to both the vertical direction and the horizontal direction, the plurality of beams including a skirt beam that is located between a horizontal center of the center frame and the rear portion of the center frame along the horizontal direction, the horizontal center of the center frame being located at a center of an entire length of the center frame along the horizontal direction, the skirt beam including:

a pair of beam side plates spaced apart from one another along the horizontal direction, each beam side plate of the pair of beam side plates having a first end disposed opposite a second end along the transverse direction, the first end of each beam side plate being welded to the side surface of the center frame, an upper surface of each beam side plate having a notch surface that extends from the first end to a notch edge, the notch edge being disposed between the first end and the second end of each beam side plate along the transverse direction, a height of each beam side plate at the first end being less than a height of each beam side plate at the notch edge along the vertical direction, the notch surface defining a notch groove in each beam side plate, such that the notch edge of each beam side plate is separated from the center frame along the transverse direction by a gap across the notch groove;

a beam upper plate integrally fixed to the pair of beam side plates, an end of the beam upper plate facing the side surface of the center frame and being separated from the center frame along the transverse direction by the gap; and a notch connection plate welded to each beam side plate and disposed between the end of the beam upper plate and the center frame along the transverse direction, the notch connection plate being welded to the side surface of the center frame at a height above a bottom of the side surface along the vertical direction that is less than a vertical center height of the center frame at the notch connection plate, the vertical center height of the center frame being a vertical distance from the bottom of the center frame to a center of an overall height of the center frame along the vertical direction.

2. The revolving frame according to claim 1, wherein the notch surface of each beam side plate further defines a notch hole, the notch hole being located between the notch groove and the first end of each beam side plate along the transverse direction, and a portion of the notch surface defining the notch hole is disposed below the notch connection plate at a location of the notch hole along the transverse direction.

3. A work machine comprising:

a lower traveling structure;

an upper revolving structure coupled to the lower traveling structure, such that the upper revolving structure revolves relative to the lower traveling structure; and a working device coupled to the upper revolving structure, wherein the upper revolving structure includes the revolving frame according to claim 1, and the working device is attached to the center frame of the revolving frame.

4. The work machine according to claim 3, wherein the supporting portion of the center frame defines a center of revolution of the upper revolving structure relative to the lower traveling structure.

5. The revolving frame according to claim 1, wherein the notch edge extends along the horizontal direction.

6. The revolving frame according to claim 1, wherein a portion of the notch surface that defines the notch groove has an L-shape.

7. The revolving frame according to claim 1, wherein the side surface of the center frame is a first side surface, the center frame has a box-shaped cross section formed by the first side surface, a second side surface, and an upper surface disposed between and welded to the first side surface and the second side surface.

8. The revolving frame according to claim 7, wherein the center frame further includes a bottom plate welded to lower portions of the first side surface and the second side surface.

9. The revolving frame according to claim 8, wherein each beam side plate is welded to the bottom plate of the center frame.

10. The revolving frame according to claim 9, wherein the bottom plate of the center frame extends below each beam side plate along the transverse direction.

11. The revolving frame according to claim 9, wherein an entirety of the notch connection plate is disposed between the bottom plate of the center frame and the notch edge of each beam side plate along the vertical direction.

12. The revolving frame according to claim 1, wherein the notch connection plate defines a concavity that faces the center frame along the transverse direction.

13. The revolving frame according to claim 1, wherein the end of the beam upper plate is disposed above an entirety of the first end of each beam side plate along the vertical direction.

14. The revolving frame according to claim 2, wherein the side surface of the center frame is a first side surface, the center frame has a box-shaped cross section formed by the first side surface, a second side surface, an upper surface disposed between and welded to the first side surface and the second side surface, and a bottom plate disposed below the upper surface along the vertical direction, and a concavity of the notch hole faces away from the bottom plate along the vertical direction.

* * * * *